US011293083B2

(12) United States Patent
Sandberg et al.

(10) Patent No.: US 11,293,083 B2
(45) Date of Patent: Apr. 5, 2022

(54) STEEL ALLOY AND A TOOL

(71) Applicant: Erasteel SAS, Paris (FR)

(72) Inventors: Fredrik Sandberg, Uppsala (SE); Delphine Rébois, Tierp (SE); Stefan Sundin, Gävle (SE)

(73) Assignee: Erasteel SAS, Paris (FR)

( * ) Notice: Subject to any disclaimer, the term of this patent is extended or adjusted under 35 U.S.C. 154(b) by 349 days.

(21) Appl. No.: 16/085,212

(22) PCT Filed: Mar. 15, 2017

(86) PCT No.: PCT/EP2017/056170
§ 371 (c)(1),
(2) Date: Sep. 14, 2018

(87) PCT Pub. No.: WO2017/158056
PCT Pub. Date: Sep. 21, 2017

(65) Prior Publication Data

US 2019/0078184 A1 Mar. 14, 2019

(30) Foreign Application Priority Data

Mar. 16, 2016 (SE) ..... 1650353-4

(51) Int. Cl.

| | |
|---|---|
| ***C22C 38/30*** | (2006.01) |
| ***C22C 38/02*** | (2006.01) |
| ***C22C 38/04*** | (2006.01) |
| ***C22C 38/00*** | (2006.01) |
| ***C22C 38/26*** | (2006.01) |

(Continued)

(52) U.S. Cl.

CPC ..... *C22C 38/30* (2013.01); *C21D 6/007* (2013.01); *C22C 38/00* (2013.01); *C22C 38/001* (2013.01); *C22C 38/02* (2013.01); *C22C 38/04* (2013.01); *C22C 38/10* (2013.01); *C22C 38/22* (2013.01); *C22C 38/24* (2013.01); *C22C 38/26* (2013.01); *C22C 38/60* (2013.01); *C21D 6/002* (2013.01);

(Continued)

(58) Field of Classification Search
None
See application file for complete search history.

(56) References Cited

U.S. PATENT DOCUMENTS

| | | | | |
|---|---|---|---|---|
| 4,224,060 | A | 9/1980 | De Souza et al. | |
| 2004/0101431 | A1* | 5/2004 | Ponemayr | C22C 38/12 420/107 |
| 2009/0007992 | A1 | 1/2009 | Caliskanoglu et al. | |

FOREIGN PATENT DOCUMENTS

| | | | |
|---|---|---|---|
| EP | 0598782 | A1 | 6/1994 |
| GB | 431248 | A | 7/1935 |

(Continued)

OTHER PUBLICATIONS

ASM International Handbook Committee. (2008; 2010). ASM Handbook, vol. 15—Casting—50.3 Characterization Methods. (pp. 402, 403). ASM International. (Year: 2010).*

*Primary Examiner* — Anthony M Liang
(74) *Attorney, Agent, or Firm* — Dilworth & Barrese, LLP

(57) ABSTRACT

A steel alloy intended for cutting applications and hot working tools, comprising, in weight percent (wt. %), C: 0.40-1.2 wt. %, Si: 0.30-2.0 wt. %, Mn: max 1.0 wt. %, Cr: 3.0-6.0 wt. %, Mo: 0-4.0 wt. %, W: 0-8.0 wt. %, wherein (Mo+W/2)≥3.5 wt. %, Nb: 0-4.0 wt. %, V: 0-4.0 wt. %, wherein 1.0 wt. %≤(Nb+V)≤4.0 wt. %, Co: 25-40 wt. %, S: max 0.30 wt. %, N: max 0.30 wt. %, the balance being Fe and unavoidable impurities.

27 Claims, 5 Drawing Sheets

(51) Int. Cl.

| | |
|---|---|
| ***C22C 38/24*** | (2006.01) |
| ***C22C 38/22*** | (2006.01) |
| ***C21D 6/00*** | (2006.01) |
| ***C22C 38/60*** | (2006.01) |
| ***C22C 38/10*** | (2006.01) |
| *C21D 6/02* | (2006.01) |

(52) U.S. Cl.
CPC ..... *C21D 6/005* (2013.01); *C21D 6/008* (2013.01); *C21D 6/02* (2013.01); *C21D 2211/004* (2013.01)

(56) References Cited

FOREIGN PATENT DOCUMENTS

| | | | | |
|---|---|---|---|---|
| GB | 1523926 | A | | 9/1978 |
| JP | 05148596 | A | * | 6/1993 |
| JP | 2010-144235 | A | | 7/2010 |
| JP | 2010274315 | A | * | 12/2010 |
| WO | 93/02818 | A1 | | 2/1993 |

* cited by examiner

STEEL ALLOY AND A TOOL

TECHNICAL FIELD OF THE INVENTION

The present invention relates to a steel alloy suitable for cutting applications and to a tool comprising such a steel alloy. The steel alloy is preferably manufactured using powder metallurgy.

The steel alloy is suitable for use in applications that require a high toughness in combination with hardness and strength, in particular hot hardness and thermal stability. Such applications include cutting tools for chip removing machining, such as end mills, gear cutting tools or milling tools formed for hobbing of workpieces, thread-cutting taps, boring tools, drilling tools, turning tools, etc. The steel alloy is also suitable for hot-working tools, such as extrusion dies, rollers for hot rolling, press rollers for stamping of patterns in metal, etc. The tools may be provided with a coating applied using physical vapour deposition (PVD) or chemical vapour deposition (CVD).

BACKGROUND AND PRIOR ART

A steel alloy suitable for cutting and hot-working applications is known from WO9302818. The steel alloy is a high speed steel alloy manufactured using powder metallurgy. It typically comprises, in weight percent (wt. %), 0.8 wt. % C, 4 wt. % Cr, 8 wt. % Co, 3 wt. % Mo, 3 wt. % W, 1 wt. % Nb, 1 wt. % V, 0.5 wt. % Si, 0.3 wt. % Mn, balance Fe and unavoidable impurities. This steel alloy has a high toughness and an excellent grindability. However, the hot hardness, i.e. the hardness at elevated temperature, and the thermal stability, i.e. the ability of the alloy to maintain its properties and microstructure over time at elevated temperature, show potential for improvement for the above mentioned applications. This should preferably be achieved while maintaining a good thermal conductivity at high temperatures, since a good thermal conductivity is desirable for cutting tools in order to conduct heat away from the cutting edge via the cutting tool. Moreover, it is desired that the steel alloy has an adequate machinability prior to hardening.

SUMMARY OF THE INVENTION

It is a primary objective of the present invention to provide a steel alloy which has improved thermal stability and hot hardness in comparison with the above discussed prior art steel alloy, in combination with an improved or at least similar thermal conductivity. It is a secondary objective to provide a tool which has excellent thermal stability and hot hardness in combination with a good thermal conductivity.

According to a first aspect of the present invention, the primary objective is achieved by means of a steel alloy according to claim 1. The steel alloy comprises:

C: 0.40-1.2 wt. %,
Si: 0.30-2.0 wt. %,
Mn: max 1.0 wt. %,
Cr: 3.0-6.0 wt. %,
Mo: 0-4.0 wt. %,
W: 0-8.0 wt. %, wherein $(Mo+W/2) \geq 3.5$ wt. %,
Nb: 0-4.0 wt. %,
V: 0-4.0 wt. %, wherein 1.0 wt. $\% \leq (Nb+V) \leq 4.0$ wt. %,
Co: 25-40 wt. %,
S: max 0.30 wt. %,
N: max 0.30 wt. %,
the balance being Fe and unavoidable impurities.

With the steel alloy according to the present invention, an improved hot hardness and thermal stability can be achieved in comparison with a similar steel alloy with a lower amount of cobalt, such as the one described above. Although the steel alloy according to the invention comprises a limited amount of expensive alloying elements such as molybdenum and tungsten, it is still possible to achieve the desired properties of the steel alloy at hot-working conditions after hardening and tempering. The steel alloy is therefore suitable for cutting machining and hot-working applications, wherein e.g. a good thermal stability is crucial. The steel alloy according to the invention has also proved to have adequate machinability in soft annealed condition, i.e. the condition in which the steel alloy is subjected to machining for forming a tool. The steel alloy also has a relatively high thermal conductivity, thus being suitable for cutting applications in which it is desired to conduct generated heat away from the cutting edge.

According to one embodiment, the steel alloy comprises 27-33 wt. % Co. This helps achieving a good hot hardness and thermal stability without having problems with hardening the steel alloy.

According to another embodiment, the steel alloy comprises 28-30 wt. % Co. Within this interval, the hot hardness and thermal stability are optimised.

According to another embodiment, the steel alloy comprises 0.60-0.90 wt. % C. Within this range, a fine grain structure and a good wear resistance can be achieved without causing brittleness.

According to another embodiment, the steel alloy comprises 0.30-1.1 wt. % Si. This reduces the risk of forming large $M_6C$ carbides and impaired hardness, while still maintaining the fluidity of the steel alloy during the melt metallurgical process.

According to another embodiment, the steel alloy comprises 3.5-5.0 wt. % Cr. In this range, Cr will contribute to a sufficient hardness and toughness after hardening and tempering, without risking retained austenite in the steel matrix.

According to another embodiment, the steel alloy comprises 0.10-0.50 wt. % Mn. At these levels, Mn can put sulfuric impurities out of action by the formation of manganese sulfides, improving the machinability of the steel alloy.

According to another embodiment, the steel alloy comprises 2.0-4.0 wt. % Mo and 2.0-4.0 wt. % W. In these amounts, Mo and W contribute to an adequate hardness and toughness of the steel matrix after hardening and tempering.

According to another embodiment, the steel alloy comprises 0.90-1.3 wt. % Nb and 0.90-1.3 wt. % V. The grindability of the steel alloy can thereby be optimised.

According to another embodiment, the steel alloy comprises max 0.080 wt. % S. In this embodiment, the steel alloy is not intentionally alloyed with sulfur, but S may be present as an impurity without effect on the mechanical properties of the steel alloy.

According to another embodiment, the steel alloy comprises less than 1.0 wt. % unavoidable impurities, preferably less than 0.75 wt. % unavoidable impurities, and more preferably less than 0.50 wt. % unavoidable impurities. Below these levels, the impurities have very little effect on the properties of the steel alloy.

According to another embodiment, the steel alloy is a powder metallurgy steel alloy. Preferably, the steel alloy is in the form of a powder metallurgy steel alloy produced by gas atomisation. Using gas atomisation, it is possible to obtain a powder metallurgy steel alloy with high purity, low level of inclusions and very fine dispersed carbides. Gas atomised powder is spherical and may be densified into a homogeneous material using for example hot isostatic pressing (HIP).

According to another aspect of the present invention, the above mentioned secondary objective is achieved by means of a tool comprising the proposed steel alloy. Such a tool has a good thermal stability, hot hardness and thermal conductivity and is therefore suitable for hot-working and cutting applications.

According to one embodiment of this aspect of the invention, the tool is a cutting tool configured for chip removing machining.

According to one embodiment of this aspect of the invention, the tool is provided with a coating applied using physical vapour deposition or chemical vapour deposition. The PVD or CVD coating forms a wear resistant outer layer.

Further advantages and advantageous features of the invention will appear from the following description of the invention and embodiments thereof.

BRIEF DESCRIPTION OF THE DRAWINGS

Embodiments of the present invention will now be described in detail with reference to the attached drawings, wherein.

DETAILED DESCRIPTION OF EMBODIMENTS OF THE INVENTION

Figure 1:
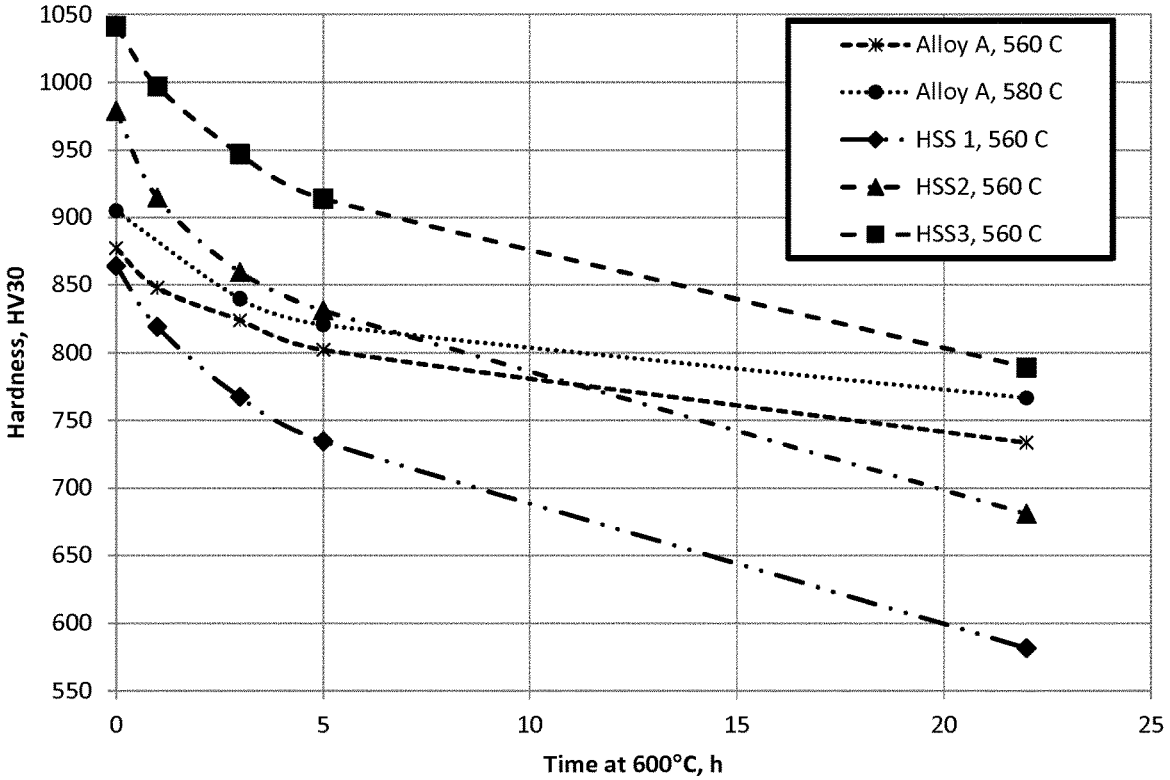
FIG. 1 shows hardness as a function of ageing time for exemplary alloys.

The importance of the various alloying elements will now be explained in greater detail.

Carbon (C) has several functions in the steel alloy. Above all, a certain amount of carbon is needed in the matrix in order to provide a suitable hardness through the formation of martensite by cooling from the dissolution temperature. The amount of carbon should be sufficient for the combination of carbon with on one hand molybdenum/tungsten, and on the other hand vanadium/niobium, such that precipitation hardening can be achieved by the formation of carbides. The carbides provide resistance to wear and also limit grain growth, thereby contributing to a fine grained structure of the steel alloy. Therefore, the carbon content in the steel shall be at least 0.40 wt. % and preferably at least 0.60 wt. %, suitably at least 0.70 wt. %. However, the carbon content must not be so high that it will cause brittleness. The carbon content should therefore not exceed 1.2 wt. %, and preferably not exceed 0.90 wt. %.

Silicon (Si) may exist in the steel as a residue from the deoxidation of the steel melt. Silicon improves the fluidity of the liquid steel, which is important in the melt metallurgical process. By increased addition of silicon the steel melt will be more fluid, which is important in order to avoid clogging in connection with granulation. The silicon content should for this purpose be at least 0.30 wt. % and even more preferred at least 0.40 wt. %. Silicon also contributes to increased carbon activity and in a silicon alloyed embodiment it can be present in amounts of up to 2.0 wt. %. Problems with brittleness will arise at contents above 2.0 wt. % and may affect the mechanical properties already at lower contents. Accordingly, the steel alloy should suitably not contain more than 1.2 wt. % Si as the risk of formation of large $M_6C$ carbides and impaired hardness in the hardened condition will be larger at silicon contents above this level. It is even more preferred to limit the silicon content to not more than 1.1 wt. %.

Manganese (Mn) can also be present in the steel alloy, primarily as a residual product from the metallurgical melt process. In this process, manganese has the known effect of putting sulfuric impurities out of action by the formation of manganese sulfides. For this purpose, it should preferably be present in the steel at a content of at least 0.10 wt. %. The maximum content of manganese in the steel is 1.0 wt. %, but preferably the content of manganese is limited to a maximum of 0.50 wt. %. In a preferred embodiment, the steel contains 0.20 to 0.40 wt. % Mn.

Chromium (Cr) shall be present in the steel alloy in an amount of at least 3.0 wt. %, preferably at least 3.5%, in order to contribute to a sufficient hardness and toughness of the steel matrix after hardening and tempering. Chromium can also contribute to the wear resistance of the steel alloy by being included in primarily precipitated carbides, mainly $M_6C$ carbides. Too much chromium, however, will cause a risk for retained austenite, which may be difficult to transform. The chromium content is therefore limited to max 6.0 wt. %, preferably to max 5.0 wt. %.

Molybdenum (Mo) and tungsten (W) contribute to an adequate hardness and toughness of the steel matrix after hardening and tempering. Molybdenum and tungsten can also be included in primarily precipitated $M_6C$ carbides and will as such contribute to the wear resistance of the steel. Also other primarily precipitated carbides contain molybdenum and tungsten, although not to the same extent. The limits for the contents of molybdenum and tungsten are chosen in order to, by adaptation to other alloying elements, result in suitable properties. In principle, molybdenum and tungsten can partially or completely replace each other, which means that tungsten can be replaced by half the amount of molybdenum, or molybdenum can be replaced by double the amount of tungsten. By experience, it is however known that about equal amounts of molybdenum and tungsten are preferred, since this result in certain advantages in production technology, or more specifically in heat treatment technology. When using raw material in the form of scrap steel, about equal amounts of molybdenum and tungsten are preferred since this puts less restraints on the type of scrap steel used. Properties suitable for the purpose will be achieved in combination with other alloying elements at a molybdenum and tungsten content such that (Mo+W/2) equals at least 3.5 wt. %, but not more than 8.0 wt. %. The content of molybdenum should be within the range 0 to 4.0 wt. % and the content of tungsten should be within the range 0 to 8.0 wt. %. Preferably, the steel alloy comprises within the range of 2.0 to 4.0 wt. % of each of molybdenum and tungsten, respectively.

Vanadium (V) and niobium (Nb) are to some degree interchangeable and in small amounts contribute to keeping down the size of carbides. By properly balancing the amounts of niobium and vanadium, the size of primarily precipitated MC carbides can be limited, thereby improving the grindability of the steel alloy. The total content of niobium and vanadium should fulfil the condition 1.0 wt. %≤(Nb+V)≤4.0 wt. %, preferably 1.5 wt. %≤(Nb+V)≤3.0 wt. %. In a preferred embodiment, the steel should contain 0.90 to 1.3 wt. % Nb and 0.90 to 1.3 wt. % V. The content of each of the elements Nb and V should be within the range 0-4.0 wt. %, i.e., it is possible to omit one of the elements and replace it with the other.

Cobalt (Co) contributes to the hot hardness and the thermal stability of the steel alloy necessary for cutting applications. Cobalt is known to reduce the toughness of steel alloys and large amounts of cobalt in steel alloys have therefore previously been avoided. However, according to the present invention, it has been found that the amount of cobalt can be increased with respect to the amount present in previously known steel alloys such as the one disclosed in WO9302818. Cobalt is in the present steel alloy present in an amount of at least 25 wt. %, preferably at least 27 wt. % and most preferably at least 28 wt. %. This provides the requested hot hardness and thermal stability. The amount of cobalt should be limited to max 40 wt. %, since above this level, the steel alloy becomes very difficult to harden to the desired hardness due to retained austenite. Preferably, the amount of cobalt is for this reason limited to max 33 wt. %, or more preferably max 31 wt. %, and even more preferably max 30 wt. %.

Sulfur (S) may be present in the steel alloy as a residual product from the manufacturing process. In amounts of less than approximately 800 ppm, i.e. 0.080 wt. %, the mechanical properties of the steel alloy are largely unaffected. Sulfur can also be deliberately added as an alloying element in order to improve the machinability of the steel alloy. However, sulfur reduces the weldability and may also cause brittleness. If alloyed with sulfur, the amount of sulfur should be limited to max 0.30 wt. %, preferably max 0.2 wt. %. In sulfur alloyed embodiments, the manganese content of the steel should preferably be somewhat higher than in non-sulfured embodiments of the steel alloy. In non-sulfured embodiments, care should be taken not to exceed 0.080 wt. % S.

Nitrogen (N) can to some extent replace carbon in the steel alloy and could be present in an amount of max 0.3 wt. %, but should preferably be limited to max 0.1 wt. %. The amounts of carbon and nitrogen should be balanced to achieve a desired amount of carbides, nitrides and carbonitrides, contributing to the wear resistance of the steel alloy.

Besides the above mentioned elements, the steel alloy may contain unavoidable impurities and other residual products in normal amounts, derived from the melt-metallurgical treatment of the steel alloy. Other elements can intentionally be supplied to the steel alloy in minor amounts, provided they do not detrimentally change the intended interactions between the alloying elements of the steel alloy and also that they do not impair the intended features of the steel alloy and its suitability for the intended applications. Impurities, such as contamination elements, can be present in the steel alloy at an amount of maximum 1.0 wt. %, preferably maximum 0.75 wt. % and more preferably maximum 0.5 wt. %. Examples of impurities that may be present are titanium (Ti), phosphorus (P), copper (Cu), tin (Sn), lead (Pb), nickel (Ni), and oxygen (O). The amount of oxygen should preferably not exceed 200 ppm, and should more preferably not exceed 100 ppm. The impurities may be naturally-occurring in the raw material used to produce the steel alloy, or may result from the production process.

The steel alloy according to the invention may be produced by a powder metallurgic process, in which a metal powder of high purity is produced using atomisation, preferably gas atomisation since this results in powder with low amounts of oxygen. The powder is thereafter densified using for example hot isostatic pressing (HIP). Typically, a capsule of low alloyed steel is filled with gas atomised powder. The capsule is sealed and consolidated to a billet with full density under high pressure and temperature. The billet is forged and rolled into a steel bar and components/tools of final shape are thereafter produced by forging and machining. Components can also be produced from steel alloy powder using a near net shape technique, in which steel alloy powder is canned in metal capsules and is consolidated into components with the desired shape under high pressure and temperature. Components can further be produced using additive manufacturing techniques.

The steel alloy according to the invention is particularly suitable for forming cutting tools for chip removing machining with integrated cutting elements. Preferably, the finished tool is provided with a PVD or a CVD coating having a face centred cubic structure and a thickness of 20 μm or less, typically 5-10 μm. Common coatings used in the field are different combinations of oxides and nitrides such as TiN, TiAlN, AlCrN, AlCrON, etc.

Example 1

A number of steel alloy test samples, with alloying element compositions as listed in Table I, were produced and tested. The balance of the listed compositions was Fe and unavoidable impurities in total amounts of less than 0.5 wt. %. Unavoidable impurities in this case include e.g. oxygen. Alloy A is a steel alloy according to an embodiment of the present invention while HSS1, HSS2 and HSS3 are comparative alloys falling outside the scope of the present invention. HSS1 is a high speed steel alloy as disclosed in WO9302818, while as HSS2 and HSS3 are more high alloyed steel alloys, containing larger amounts of V, Mo and W as well as a larger amount of C. HSS2 and HSS3 are examples of the most high performance powder metallurgy high speed steel alloys for cutting applications.

TABLE I

| Alloy | C | Cr | Co | Mo | W | Nb | V | Si | Mn | S | N |
|---|---|---|---|---|---|---|---|---|---|---|---|
| A | 0.77 | 4.1 | 30 | 2.7 | 3.1 | 1.1 | 1.1 | 1.1 | 0.30 | <0.06 | 0.006 |
| HSS1 | 0.80 | 4.0 | 8.0 | 3.0 | 3.0 | 1.1 | 1.1 | 0.50 | 0.32 | <0.025 | — |
| HSS2 | 2.30 | 4.2 | 10.5 | 7.0 | 6.5 | — | 6.5 | 0.50 | 0.30 | <0.025 | — |
| HSS3 | 2.45 | 4.0 | 16.0 | 5.0 | 11.0 | — | 6.3 | 0.50 | 0.30 | <0.025 | — |

The listed steel alloys were produced by powder metallurgy. First, steel alloy powders were produced using gas atomisation, and thereafter the powders were enclosed in capsules and densified into solid samples by means of hot isostatic pressing (HIP). The densified samples were soft annealed in a furnace at 910° C. for a holding time of 3 hours at temperature, followed by slow cooling at a cooling rate of −10° C./h down to 670° C. The samples were thereafter slowly cooled to room temperature.

The Brinell hardness after soft annealing, i.e. the soft annealed hardness, was determined for alloy A using two indents per sample. The soft annealed hardness of alloy A was 450 HB, i.e. approximately 47 HRC. By adding a fast quenching in a vacuum furnace during cooling of the sample after soft annealing, it was possible to reduce the soft annealed hardness to 390 HB.

The machinability of the soft annealed samples was tested for alloy A and for HSS2. The soft annealed hardness for the tested samples was 425 HB for alloy A and 355 HB for HSS2. The soft machining was carried out by milling with a coated cemented carbide milling insert. 2 mm deep cuts were formed with one milling insert mounted in a milling head of the tool. The feed was kept constant at 0.15 mm per turn and the cutting speed was varied between 80 to 120 rpm. The number of cuts until the milling insert broke down was recorded and are shown in Table II.

TABLE II

| Cutting speed (rpm) | Alloy A (no. of cuts) | HSS2 (no. of cuts) |
|---|---|---|
| 80 | 7 | 12 |
| 100 | 10 | 7 |
| 120 | 5.2 | 5.5 |

As can be seen from Table II, the machinability in soft annealed condition is comparable for alloy A according to the invention and for HSS2, even though the soft annealed hardness of alloy A is higher, as discussed above. From the higher soft annealed hardness, a reduced machinability would normally be expected. For an increase in soft annealed hardness of 70 HB, it would normally be expected that the possible cutting speed would be reduced by 50%. However, for alloy A according to the invention, the possible cutting speed is comparable with that of HSS2.

Soft annealed samples from alloy A, HSS1 and HSS3 were also subjected to hardening and tempering at different temperatures. The samples were tempered for 3×1 hour.

The Vickers hardness with a 10 kg load (HV10) of the heat treated samples was measured on one sample from each combination of alloy and heat treatment. Five indents were made per sample. The Vickers hardness with a 30 kg load (HV30) was further measured for some of the heat treated samples with ten indents per sample. Indents that were obviously affected by porosity were disregarded when measuring the Vickers hardness with a 30 kg load. Results of the Vickers hardness test are shown in Table III. The hardness values HV10 and HV30 shown are average hardness values.

TABLE III

| Alloy | Hardening temperature, ° C. | Tempering temperature, ° C. | HV10 | HV30 |
|---|---|---|---|---|
| A | 1150 | — | 725.5 | — |
| | | 560 | 919.6 | 918.7 |
| | | 580 | 893.8 | 884.9 |
| HSS1 | 1180 | — | 854.2 | — |
| | | 560 | 864.4 | 873.5 |
| | | 580 | 818.4 | — |

TABLE III-continued

| Alloy | Hardening temperature, ° C. | Tempering temperature, ° C. | HV10 | HV30 |
|---|---|---|---|---|
| HSS3 | 1180 | — | 847.4 | — |
| | | 560 | 1050.6 | 1048.1 |
| | | 580 | 1004.0 | — |

For alloy A, the hardening at 1150° C. results in a microstructure with carbides of MC type and $M_6C$ type, having an mean size of approximately 0.5 μm, wherein the MC carbides constitute around 2 volume percent (vol. %) of the total structure, and wherein the $M_6C$ carbides constitute about 2-3 vol. % of the total structure, as measured using image analysis of scanning electron microscopy (SEM) images. Corresponding values for HSS1 are 0.25 μm and 1.9 vol. % (MC) and 1.7 vol. % ($M_6C$), respectively. For HSS3, corresponding values are 1.1 μm and 17 vol. % (MC) and 5.4 vol. % ($M_6C$), respectively.

Samples from each of the alloys listed in Table I were subjected to an elevated temperature of 600° C. for different durations of time in a tempering furnace. Prior to being held at this temperature, the samples were subjected to heat treatments including tempering as described above, with a hardening temperature of 1180° C. and tempering temperatures of 560° C. (all samples) and 580° C. (only alloy A samples). The samples were held at a temperature of 600° C. for 1 h, 3 h, 5 h and 22 h, respectively. In addition, one sample per combination of alloy and heat treatment was not subjected to the elevated temperature in order to get a reference point. After being held at 600° C., all samples were cast in plastic moulds and ground. Ten Vickers hardness indents were made per sample at room temperature with a 30 kg load. Indents that were obviously affected by porosity in the materials were disregarded.

Results of the trials are shown in FIG. 1, where hardness values HV30 as a function of time held at 600° C. are plotted for the different samples. The tempering temperatures of the different samples are shown in the legend. As can be seen, alloy A has a clearly higher hardness than HSS1.

Figure 2:
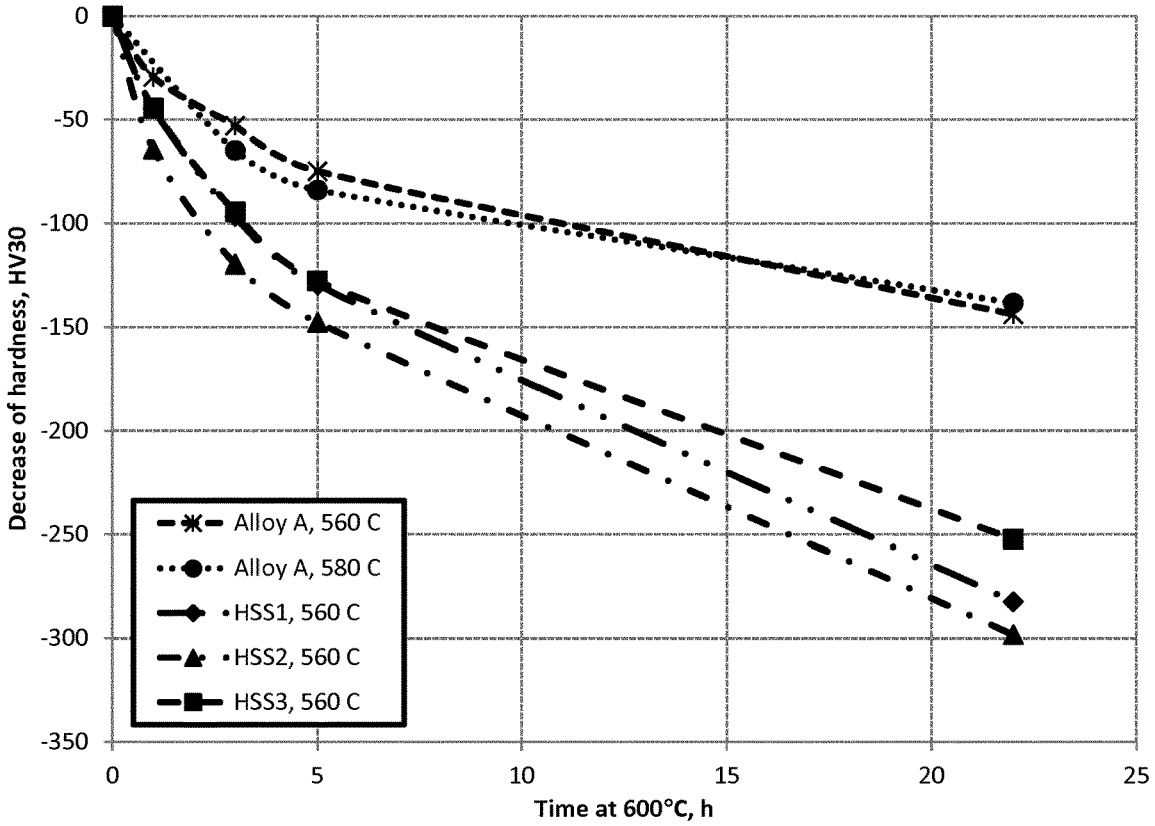
FIG. 2 shows decrease in hardness as a function of ageing time for exemplary alloys.

FIG. 2 shows the decrease in hardness HV30 as a function of time held at 600° C. for the different samples, wherein the decrease is relative to the hardness of the corresponding samples not being held at 600° C. The tempering temperatures of the different samples are shown in the legend. As can be seen from the results, for both tempering temperatures, the decrease in hardness is significantly smaller for alloy A according to the invention than for the comparative alloys HSS1, HSS2 and HSS3. The alloy according to this embodiment of the invention thus shows an improved thermal stability with respect to all of the comparative alloys.

Figure 4:
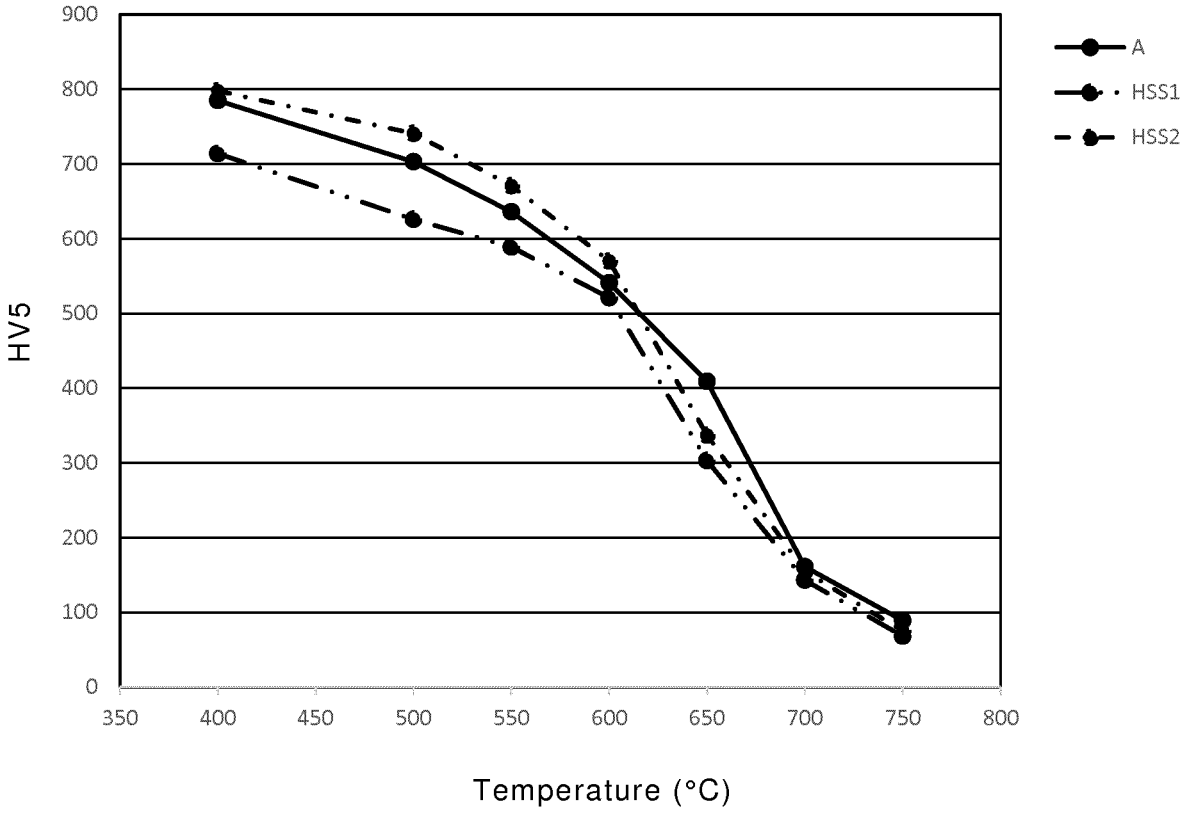
FIG. 4 shows hot hardness as a function of temperature for exemplary alloys.

The hot hardness of samples that were subjected to hardening was also measured. For each combination of alloy, heat treatment and test temperature, two Vickers hardness indents were made with a 5 kg load. Results of the hot hardness test are shown in Table IV, showing Vickers hardness (HV5) at different temperatures. All samples were hardened at 1180° C., but tempering was performed at 580° C. for alloy A and at 560° C. for HSS1 and HSS2. As can be seen, alloy A exhibits increased hot hardness with respect to HSS1 at all temperatures, and a slight improvement in hot hardness at temperatures of 650° C. and above with respect to HSS2. The hot hardness is also shown in FIG. 4, in which hardness is plotted as a function of temperature for all three alloys.

TABLE IV

| Alloy | 400° C. | 500° C. | 550° C. | 600° C. | 650° C. | 700° C. | 750° C. |
|---|---|---|---|---|---|---|---|
| A | 785 | 703 | 636 | 541 | 409 | 161 | 89 |
| HSS1 | 714 | 626 | 589 | 521 | 303 | 143 | 68 |
| HSS2 | 798 | 741 | 671 | 570 | 337 | 155 | 75 |

Figure 3:
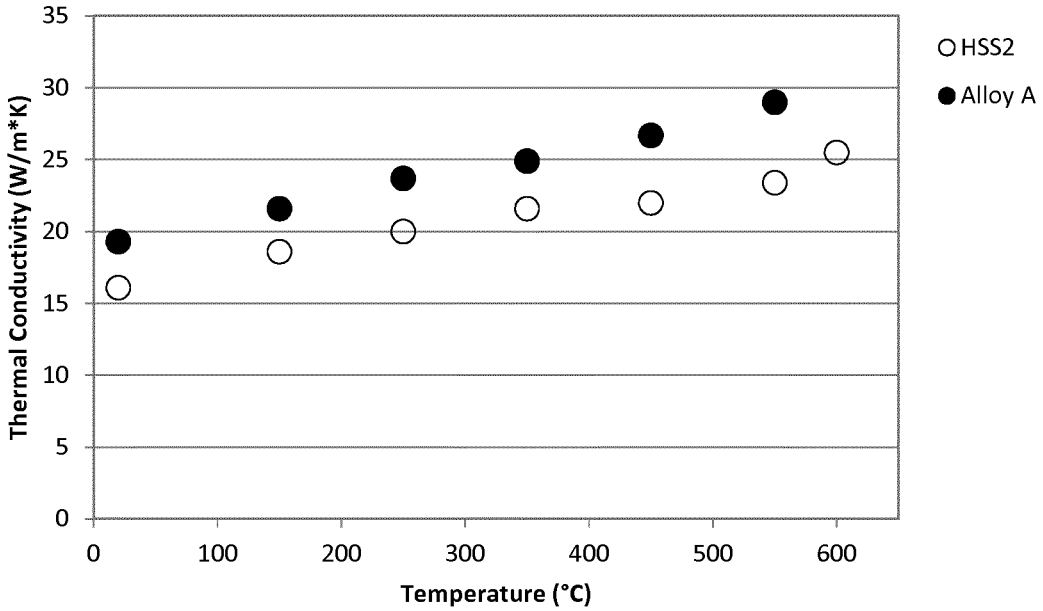
FIG. 3 shows thermal conductivity as a function of temperature for exemplary alloys.

The thermal conductivities of samples from alloy A and HSS2 were determined using a laser flash technique. Results from the measurements are shown in FIG. 3, showing that the thermal conductivity of alloy A according to the invention is improved with respect to the alloy HSS2.

Figure 5:
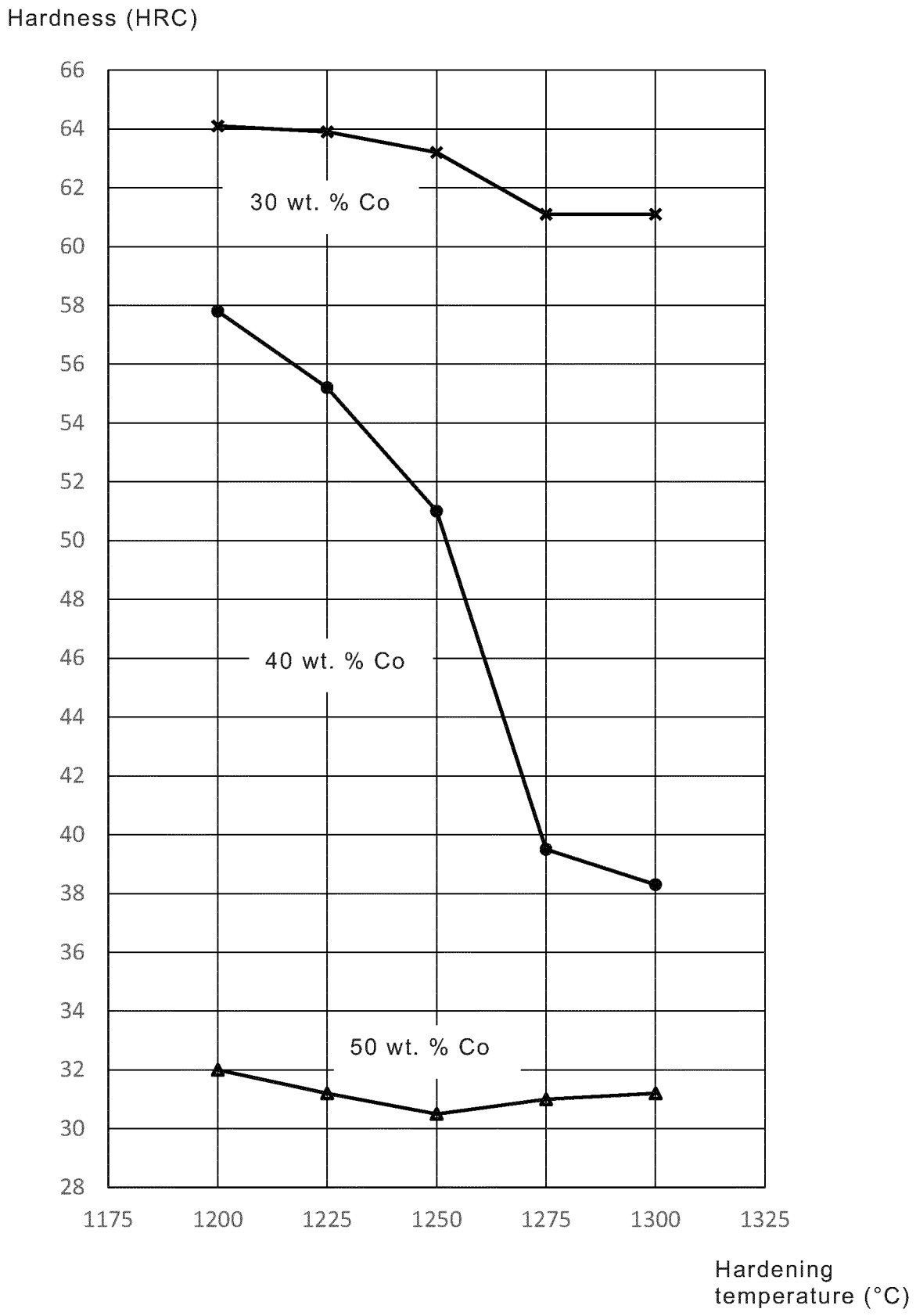
FIG. 5 shows hardness as a function of hardening temperature for a number of alloys with different Co content.

Experiments with alloys comprising 1.3 wt. % C, 4.2 wt. % Cr, 5.0 wt. % Mo, 6.4 wt. % W, 3.1 wt. % V, and with a Co content of 30 wt. %, 40 wt. % and 50 wt. %, respectively, balance Fe, have shown that a Co content of 40 wt. % and above renders the steel alloy difficult or impossible to harden to the demanded hardness. Results from such experiments are shown in FIG. 5, showing hardness in HRC as a function of hardening temperature in degrees Celsius for the three different alloys. It is expected that a corresponding reduction in hardenability would result for a composition according to the invention, but with a higher Co content.

Example 2

A further set of steel alloy test samples, with alloying element compositions as listed in Table V, were produced and tested. The balance of the listed compositions was Fe and unavoidable impurities in total amounts of less than 0.5 wt. %. Unavoidable impurities include e.g. oxygen, copper, and nickel. The listed test samples were produced as described in Example 1 above.

TABLE V

| Alloy | C | Cr | Co | Mo | W | Nb | V | Si | Mn | S | N |
|---|---|---|---|---|---|---|---|---|---|---|---|
| MS1 | 0.7 | 4.17 | 24.8 | 2.84 | 2.82 | 1.11 | 0.96 | 0.52 | 0.32 | 0.004 | 0.02 |
| MS2 | 0.53 | 4.21 | 29.9 | 2.81 | 2.85 | 1.07 | 0.98 | 0.52 | 0.32 | 0.0039 | 0.02 |
| MS3 | 0.77 | 3.97 | 28.8 | 2.85 | 2.8 | 0.99 | 1.04 | 0.51 | 0.3 | 0.007 | 0.026 |
| MS4 | 0.60 | 4.14 | 29.6 | 2.84 | 2.87 | 1.04 | 1.01 | 0.52 | 0.32 | 0.004 | 0.0015 |
| MS5 | 0.75 | 3.98 | 28.7 | 2.83 | 2.77 | 1 | 1.01 | 0.5 | 0.3 | 0.007 | 0.0015 |

Soft annealed samples in the form of bars of the different alloys MS1-MS5 were subjected to hardening and tempering at different temperatures and times according to Table VI. The alloy HSS2 from Example 1 is also included as a reference.

TABLE VI

| Sample no. | Hardening temperature (° C.) | Tempering |
|---|---|---|
| MS3-1 | 1000 | 2 × 1 h at 580° C. |
| MS3-2 | 1050 | 2 × 1 h at 580° C. |
| MS3-3 | 1100 | 2 × 1 h at 580° C. |
| MS3-4 | 1150 | 2 × 1 h at 580° C. |
| MS3-5 | 1180 | 2 × 1 h at 580° C. |
| MS3-6 | 1150 | 2 × 1 h at 600° C. |
| MS3-7 | 1150 | 3 × 1 h at 560° C. |
| MS3-8 | 1150 | 3 × 1 h at 580° C. |
| MS1-7 | 1150 | 3 × 1 h at 560° C. |
| MS1-8 | 1150 | 3 × 1 h at 580° C. |
| MS5-7 | 1150 | 3 × 1 h at 560° C. |
| MS5-8 | 1150 | 3 × 1 h at 580° C. |
| HSS2 | 1180 | 3 × 1 h at 560° C. |

The impact toughness of samples from the alloy MS3, namely samples MS3-2, MS3-4 and MS3-6, was investigated and compared to that of HSS2 described in Example 1 above. For this purpose, samples having a dimension of 7×10 mm were cut out in the longitudinal direction of the bars. The results are shown in Table VII. As can be seen, the impact toughness of the alloy MS3 has been found to be in parity with that of the alloy HSS2 for similar hardness values.

TABLE VII

| Sample no. | Hardness (HRC) | Impact toughness (J) | Bend strength (kN/mm$^2$) |
|---|---|---|---|
| MS3-1 | 65 | — | 4.5 |
| MS3-2 | 67 | 16 | 4.2 |
| MS3-3 | 67 | — | 3.5 |
| MS3-4 | 69 | 13 | 3.0 |
| MS3-5 | 69 | — | 2.7 |
| MS3-6 | 66 | 12 | — |
| HSS2 | 70 | 13 | 3.5 |

All three samples MS3-2, MS3-4 and MS3-6 have relatively high impact toughness, with the sample MS3-2 being hardened at 1050° C. showing the highest value of 16 J. The relatively high impact toughness is beneficial for cutting applications, in particular for interrupted cutting wherein the cutting edge moves into and out from a work piece. The cutting edge is thereby periodically loaded and unloaded and strength and toughness of the edge is therefore needed. Low strength or toughness may limit the feed rate that can be used, and low strength or toughness can also lead to sudden and non-predicted failure of the cutting edge. Large tools, such as gear cutting tools, can also be extra sensitive to handling damages and good strength and impact toughness is also for this reason advantageous.

The bend strength of samples from the alloy MS3, namely samples MS3-1, MS3-2, MS3-3, MS3-4 and MS3-5, was also investigated and compared to that of HSS2. For this purpose, cylindrical samples having a diameter of 4.7 mm were cut out and tested using a four point bend test. The results are shown in Table VII. It was found that the bend strength was in parity with that of alloy HSS2. All samples exhibit relatively high bend strength, with the sample MS3-1 being hardened at 1000° C. showing the highest value. A high bend strength is particularly beneficial for cutting applications.

Figure 6:
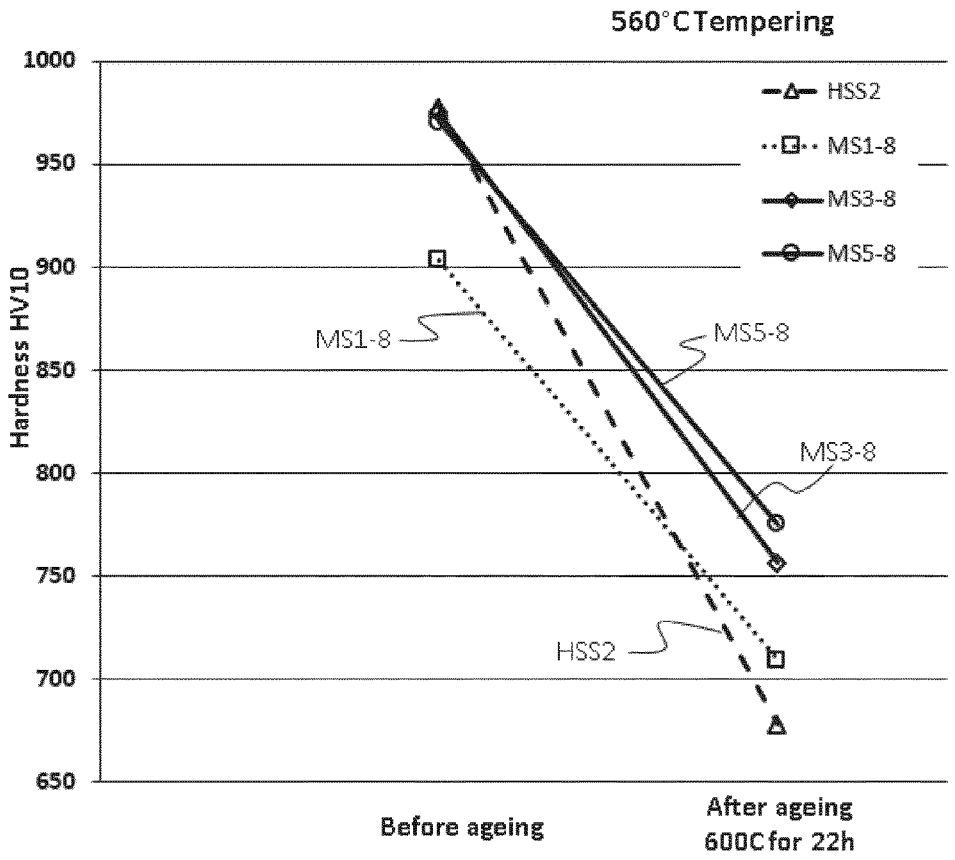
FIG. 6 shows hardness before and after ageing for exemplary alloys according to embodiments of the invention.
Figure 7:
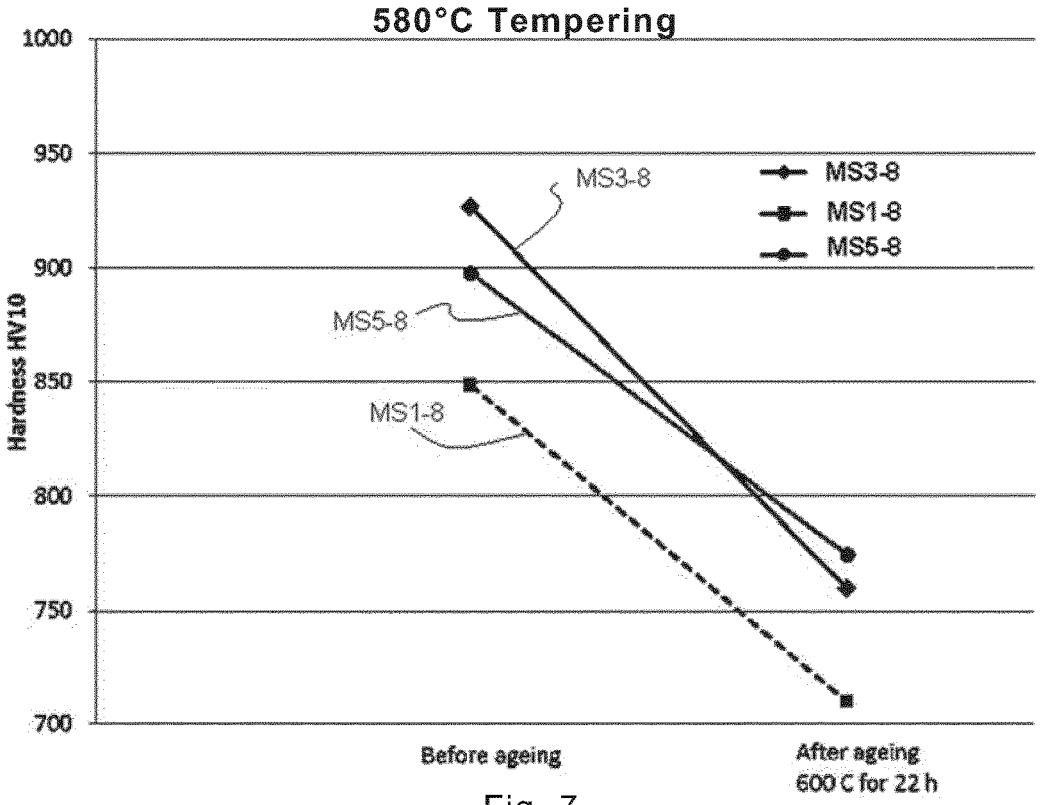
FIG. 7 shows hardness before and after ageing for exemplary alloys according to embodiments of the invention.

Samples of the type MS1-7, MS3-7, MS5-7, MS1-8, MS3-8 and MS5-8 listed in Table VI were subjected to ageing at an elevated temperature of 600° C. for 22 hours in a tempering furnace, and the Vickers hardness with a 10 kg load (HV10) was measured before and after ageing. FIGS. 6 and 7 show the influence of the cobalt content on the hardness HV10 before and after ageing for samples tempered at 560° C. and 580° C., respectively. The hardness HV30 of HSS2 from FIG. 1 is included as a reference. It can be seen that alloy MS1, having a Co content of 24.8 wt. %, i.e. approximately 25 wt. %, has a lower hardness both prior to and after ageing than the alloys MS3 and MS5, both having a Co content of approximately 29 wt. %. All alloys MS1, MS3 and MS5 have a higher hardness after ageing than HSS2. A high hardness after ageing indicates good thermal stability and ability to be used for a long time at elevated temperature. For a cutting edge made of the alloy, this means that the cutting edge may be used for a relatively long time at a high cutting speed.

Figure 8:
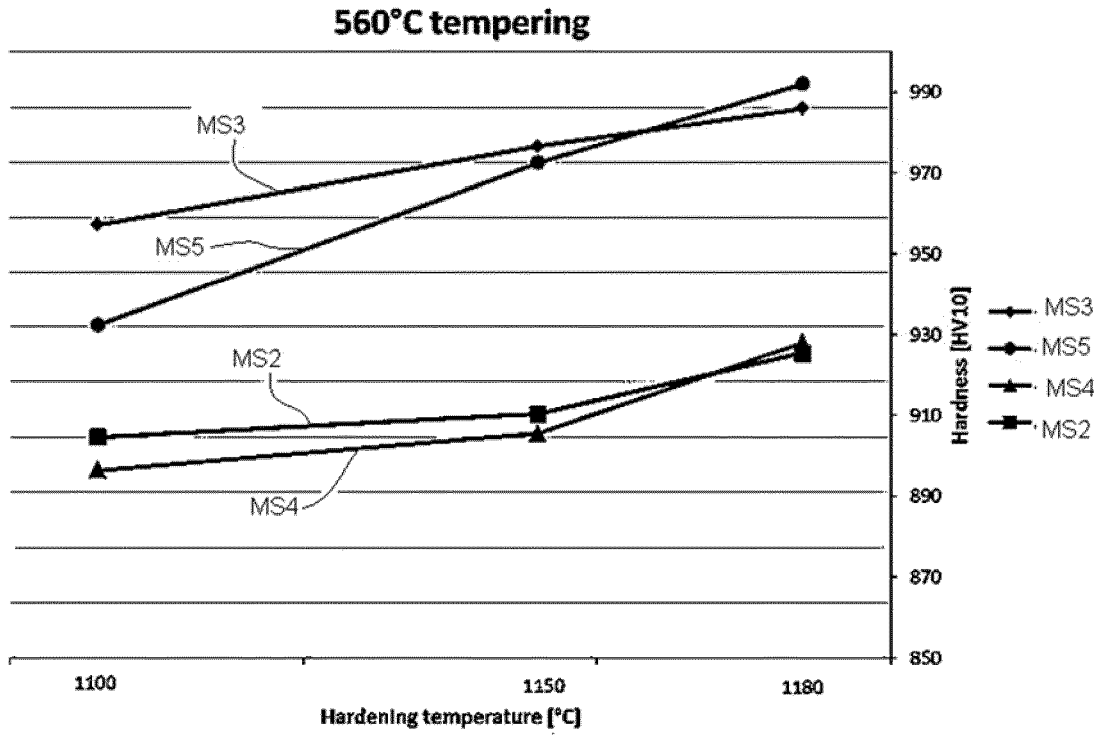
FIG. 8 shows hardness as a function of hardening temperature for exemplary alloys according to embodiments of the invention.
Figure 9:
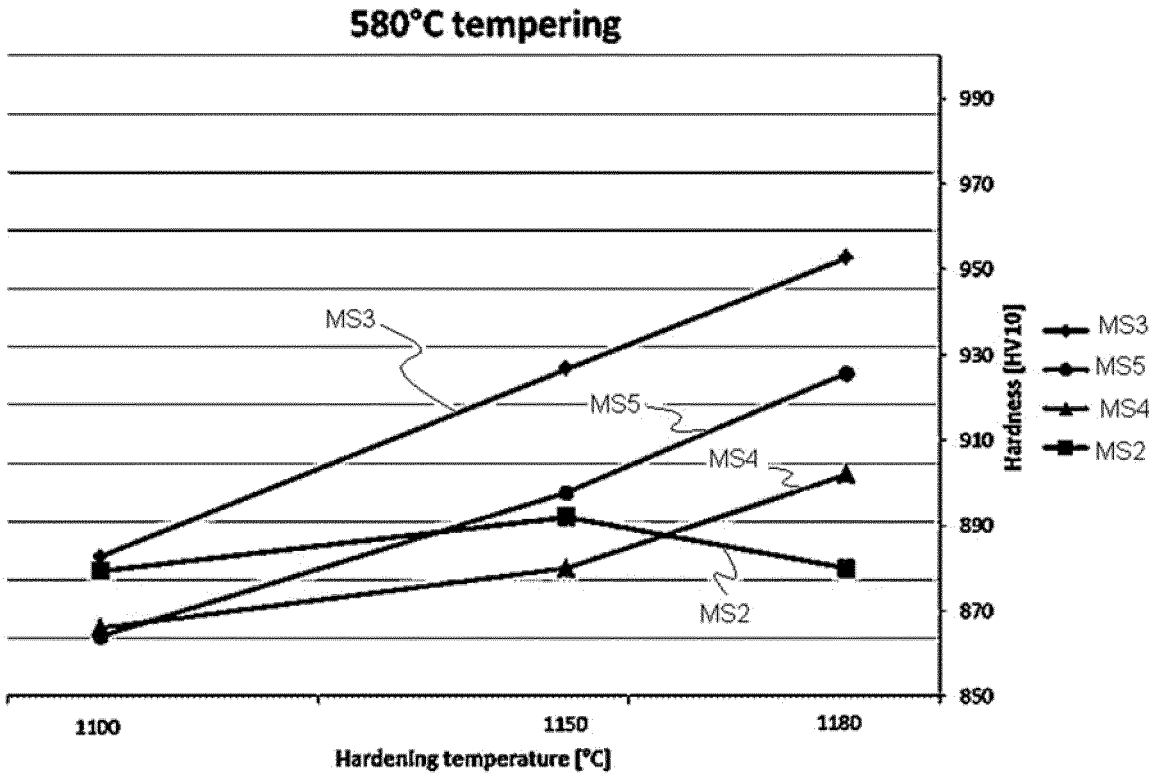
FIG. 9 shows hardness as a function of hardening temperature for the alloys in FIG. 8.

Furthermore, the influence of the carbon content of the alloy on the hardness as a function of hardening temperature was investigated for two different tempering temperatures. For this purpose, samples of the alloys MS2 (0.53 wt. % C), MS3 (0.77 wt. % C), MS4 (0.60 wt. % C) and MS5 (0.75 wt. % C) were hardened at 1100° C., 1150° C. or 1180° C. The samples were thereafter tempered for 3×1 hour at 560° C. or 580° C. The resulting hardness HV10 is shown in FIGS. 8 and 9, respectively. It can be seen that the carbon content affects the hardness of the alloy, wherein a higher carbon content generally results in that a higher hardness can be achieved with proper hardening and tempering, in particular for hardening at 1180° C. followed by tempering at 560° C. If it is desirable to temper at 580° C. in order to achieve better thermal stability, the carbon content should preferably be set above 0.60 wt. %. Carbon contents of more than 0.60 wt. % are seen to be beneficial for achieving a high hardness. For cutting applications, a hardness before ageing of at least 900 HV10 is usually desirable.

The invention is of course not limited to the embodiments disclosed, but may be varied and modified within the scope of the following claims.

The invention claimed is:

1. A homogenous, hot isostatically pressed steel alloy comprising, in weight percent (wt. %), C: 0.60-0.90 wt. %,
Si: 0.30-2.0 wt. %,
Mn: 0.1-1.0 wt. %,
Cr: 3.0-6.0 wt. %,
Mo: 0-4.0 wt. %,
W: 0-8.0 wt. %, wherein 8.0 wt. %≥(Mo+W/2)≥3.5 wt. %,
Nb: 0.90-1.3 wt. %,
V: 0.90-1.3 wt. %, wherein
1.8 wt. %≤(Nb+V)≤2.6 wt. %,
Co: 25-40 wt. %, and
S: 0.0039-0.30 wt. %, and/or
N: 0.02-0.30 wt. %,
the balance being Fe and less than 1.0 wt. % unavoidable impurities.

2. The steel alloy according to claim 1, comprising 27-33 wt. % Co.

3. The steel alloy according to claim 1, comprising 28-30 wt. % Co.

4. The steel alloy according to claim 1, comprising 0.30-1.1 wt. % Si.

5. The steel alloy according to claim 1, comprising 3.5-5.0 wt. % Cr.

6. The steel alloy according to claim 1, comprising 0.10-0.50 wt. % Mn.

7. The steel alloy according to claim 1, comprising 2.0-4.0 wt. % Mo and 2.0-4.0 wt. % W.

8. The steel alloy according to claim 1, comprising max 0.080 wt. % S.

9. The steel alloy according to claim 1, comprising less than 0.75 wt. % unavoidable impurities.

10. The steel alloy according to claim 1, wherein the steel alloy is a powder metallurgy steel alloy.

11. A tool comprising a steel alloy according to claim 1.

12. A tool according to claim 11, wherein the tool is a cutting tool configured for chip removing machining.

13. A tool according to claim 11, wherein the tool is provided with a coating applied using physical vapour deposition or chemical vapour deposition.

14. A tool according to claim 12, wherein the tool is provided with a coating applied using physical vapour deposition or chemical vapour deposition.

15. The steel alloy according to claim 3, comprising 0.30-1.1 wt. % Si.

16. The steel alloy according to claim 2, comprising 0.30-1.1 wt. % Si.

17. The steel alloy according to claim 16, comprising 3.5-5.0 wt. % Cr.

18. The steel alloy according to claim 15, comprising 3.5-5.0 wt. % Cr.

19. The steel alloy according to claim 4, comprising 3.5-5.0 wt. % Cr.

20. The steel alloy according to claim 9, comprising less than 0.50 wt. % unavoidable impurities.

21. The steel alloy according to claim 1, in capsule form.

22. The steel alloy according to claim 1, having a microstructure comprising MC and $M_6C$ carbides.

23. The steel alloy according to claim 1, having a microstructure containing finely-dispersed carbides.

24. The steel alloy according to claim 1, having less than 0.75 wt. % unavoidable impurities.

25. The steel alloy according to claim 24, having less than 0.5 wt. % unavoidable impurities.

26. The steel alloy according to claim 1, wherein an amount of oxygen does not exceed 200 ppm.

27. The steel alloy according to claim 1, wherein an amount of oxygen does not exceed 100 ppm.

* * * * *